US005541560A

United States Patent [19]

Turunen et al.

[11] Patent Number: 5,541,560

[45] Date of Patent: Jul. 30, 1996

[54] SELECTABLE BANDSTOP/BANDPASS FILTER WITH SWITCHES SELECTING THE RESONATOR COUPLING

[75] Inventors: Aimo Turunen; Heli Jantunen, both of Oulu, Finland

[73] Assignee: LK-Products Oy, Kempele, Finland

[21] Appl. No.: 202,940

[22] Filed: Feb. 28, 1994

[30] Foreign Application Priority Data

Mar. 3, 1993 [FI] Finland ..... 930942

[51] Int. Cl.[6] ..... H01P 1/202

[52] U.S. Cl. ..... 333/207; 333/134

[58] Field of Search ..... 333/174–176, 333/202–207

[56] References Cited

U.S. PATENT DOCUMENTS

| | | | |
|---|---|---|---|
| 4,467,296 | 8/1984 | Cohen et al. | 333/202 |
| 4,714,906 | 12/1987 | D'Albaret et al. | 333/202 |
| 4,742,562 | 5/1988 | Kommrusch | 333/202 X |
| 4,980,660 | 12/1990 | Nakamura et al. | 333/207 X |
| 5,021,757 | 6/1991 | Kobayashi et al. | 333/205 |
| 5,055,808 | 10/1991 | Walker et al. | 333/207 |
| 5,065,121 | 11/1991 | Ghadaksaz | 333/235 |
| 5,103,197 | 4/1992 | Turunen et al. | 333/206 |
| 5,239,279 | 8/1993 | Turunen et al. | 333/206 X |

FOREIGN PATENT DOCUMENTS

| | | | |
|---|---|---|---|
| 0318119A3 | 11/1988 | European Pat. Off. . | |
| 0472319A1 | 8/1991 | European Pat. Off. . | |
| 0520641 | 12/1992 | European Pat. Off. . | |
| 0569002 | 11/1993 | European Pat. Off. | 333/204 |
| 3641110A1 | 6/1987 | Germany . | |
| 3918257A1 | 12/1990 | Germany . | |
| 1271441 | 4/1969 | United Kingdom . | |
| 2246670 | 2/1992 | United Kingdom . | |

OTHER PUBLICATIONS

J. L. Lacombe, "Switchable Band-Stop Filter For M.I.C.", 14th European Microwave Conference, Sep. 101–13, 1984, cover page and pp. 376–381.

Patent Abstracts of Japan, vol. 9,No. 185 (E-332)(1908), Jul. 31, 1985 & JP-A-60 055 702 (Mitsubishi Denki K.K.), Apr. 1, 1985, 1 page.

*Primary Examiner*—Benny Lee
*Assistant Examiner*—Justin P. Bettendorf
*Attorney, Agent, or Firm*—Darby & Darby

[57] ABSTRACT

A dielectric filter (1) comprises a body of dielectric material, having two bores (3) running therethrough acting as resonators. The sides of the body are covered in a metallic coating apart from an upper surface (2) and one side surface (4). Electrode patterns are provided on the uncoated side surface to provide inductive and capacitive coupling between the resonators. By providing switches 8, the ratio of inductive to capacitive coupling can be changed thus allowing the filter to act as a bandstop or bandpass filter depending upon whether the switches are open or closed.

13 Claims, 5 Drawing Sheets

SELECTABLE BANDSTOP/BANDPASS FILTER WITH SWITCHES SELECTING THE RESONATOR COUPLING

The present invention relates to a filter for selectively attenuating or passing a range of radio frequency signals comprising at least two mutually coupled resonators.

BACKGROUND OF THE INVENTION

As is well known to persons skilled in the art, filters having the desired properties can be realised by the appropriate interconnection of a number of resonators. The resonators are in the form of a transmission line resonator corresponding to the parallel connection of an inductance and a capacitance. It is also well known in the art in high frequency technology to use different types of resonators for different applications according to the conditions and the desired properties. Known resonator types include dielectric, helical, strip line and air-insulated rod resonators each having a relevant range of uses. For example, dielectric resonators and filters constructed therefrom are commonly used in high frequency technology and are useful in a number of applications because of their small size and weight, stability and power resistance. For instance, a dielectric filter, for use in a duplex filter, can be constructed from separate ceramic blocks or from one block provided with a number of resonators in which the coupling therebetween is accomplished electromagnetically within the ceramic material. A dielectric stop filter is usually composed of separate blocks, with coupling between the resonators via the dielectric material being prevented completely. A filter described above and used in the first end of the duplex filter may equally be constructed from helical, strip line or coaxial resonators. All of these are filter designs well known to a person skilled in the art, and therefore, they are not described herein any further detail.

Generally speaking a filter is an electrical circuit which passes certain frequencies and stops (or attenuates) other frequencies. For instance in telecommunications technology use filters which pass a desired range of frequencies while attenuating other frequencies—known as a bandpass filter and filters which attenuate a desired range of frequencies while passing other frequencies—known as a bandstop filter are commonly used.

It is known to persons skilled in the art to have a coupling between the resonators which is purely inductive or capacitive or a combination of these. The inductive coupling is generally made closer to the grounded (bottom) end of the resonator where the current is higher, whereas the current is substanstially zero at the open circuit (top) end of the resonator, where the impedance is high, and thus the coupling between the resonators is capacitive. It is known to a person skilled in the art to realize the coupling to, or between, the resonators either purely inductively or capacitively, or, in different ways, as a combination of these.

In radio transceiver systems e.g. in radio telephone systems the receive band is often at higher frequencies than the transmit band, and usually two bandpass filters are used as the filters in the receive and transmit sections of the transceiver. On the other hand, as the filter in the radiotransceivers transmitter section, it is also possible to use a bandstop filter instead of a bandpass filter, in which the resonators act as absorbing circuits at the resonance frequencies and pass lower frequencies and act as a low-pass filter. In the radiotransceiver's receive section receive it is possible to use a bandpass filter, in which the resonance frequencies of the resonators are located in the receive band, whereby they attenuate other frequencies, i.e. the filter acts as a bandpass filter. Usually the filters in the transmit and receive branch are different blocks, but they may be combined or can be a part of the same component block.

According to the present invention, there is provided a filter characterised in that, in a first mode, the filter is operable to attenuate the range of radio frequency signals, and, in a second mode, the filter is operable to pass the range of radio frequency signals. This has the advantage of having one filter that can be either a bandstop or bandpass filter, the filter type being selectable, in situ.

Such filters can be used, for example, in the transmit and receive branch of a radiotransceivers duplex filter, e.g. as a bandpass filter in the receive section which for the transmitter branch filter is changed into a bandstop filter. Thus the filters in the transmitter and receive section of a duplex filter can be manufactured more economically by making them with the same basic structure, whereby the size of the production batch increases, thus providing lower production costs.

A known bandstop filter is illustrated in FIG. 1 and comprises two resonaters RES1, RES2. A transmission line TL1, TL2 is galvanically coupled at a suitable point A, B to each resonator RES1 and RES2. Each coupling point A,B will determine the impedance level of each respective resonator RES1, RES2, and by suitably selecting this coupling point the resonator can be matched to the rest of the circuit. This matching, in which the coupling point forms a tap to the resonator, is called tapping and the coupling point A, B is called the tapping point. When helical resonators are used they are accordingly matched by tapping, whereby the connecting conductor is e.g. soldered to a certain point of the coil of the helical resonator, usually to the first turn of the coil. The resonators RES1, RES2 form a filter when the resonators are mutually coupled. The coupling can be made either capacitively or inductively or as a combination of these, depending on the desired filter. When the resonators have a reactive i.e. inductive coupling using coil or transmission line L, a bandstop filter is obtained which in this case is a low-pass filter. Then this reactive coupling is realized by a physical component L. This low-pass filter shown in FIG. 1 has transmission zeros at the resonance frequencies of the resonators RES1, RES2, so that the filter attenuates a signal at these resonance frequencies. To obtain a high-pass filter the transmission lines TL1, TL2 are replaced by capacitances. The filter input IN and the output OUT are obtained at the other end E, F of the transmission lines coupled to the. resonators.

When the resonators of the filter according to FIG. 1 are also coupled capacitively to each other, so that the capacitance substantially cancels the inductance, then we obtain a filter of the bandpass type, which acts as a bandpass filter at the stopband frequency of the bandstop filter. Further, when the coupling between the resonators RES1, RES2 is adjusted, we can shift the passband of the bandpass filter for instance so, that when the bandstop filter provided in the transmit branch is altered to be the bandpass filter provided in the receive branch, its passband is at slightly higher frequencies than the stopband of the bandstop filter.

The bandstop filter shown in FIG. 1 can be altered into a bandpass filter by having the inductive coupling L between the resonators RES1, RES2 and also a capacitive coupling C, preferably at the high impedance i.e. open-circuit, end of the resonators, as is shown in FIG. 2. When the resonators RES1, RES2 have inductive and capacitive couplings, the filter type i.e. either bandstop or bandpass is determined by the ratio of the capacitive and the inductive coupling, which provides a bandstop filter when the inductive coupling is dominant and a bandpass filter when the capacitive coupling is dominant. In the case of FIG. 2 a bandpass filter is obtained, in which the resonance frequencies of the resonators RES1, RES2 determine the frequency of the passband. When the capacitive coupling is strong, the capacitance cancels the inductance and a signal passes mainly through the capacitive coupling at passband frequencies of the filter, whereas the resonators RES1, RES2 appear as high impedances at the stopband frequencies thus attenuating the signal at these stopband frequencies. When we further provide the filter with adjusting components, known to a person skilled in the art, for shifting the resonance frequency of the resonators, we obtain a bandpass filter in which the passband is at slightly different frequencies than the stopband of the bandstop filter used as the basic component, i.e. the filter before being changed to a bandpass filter.

BRIEF DESCRIPTION OF THE DRAWINGS

The invention will now be described, by way of example only with reference to the accompanying drawings, of which.

DETAILED DESCRIPTION OF THE PREFERRED EMBODIMENT

Figure 1:
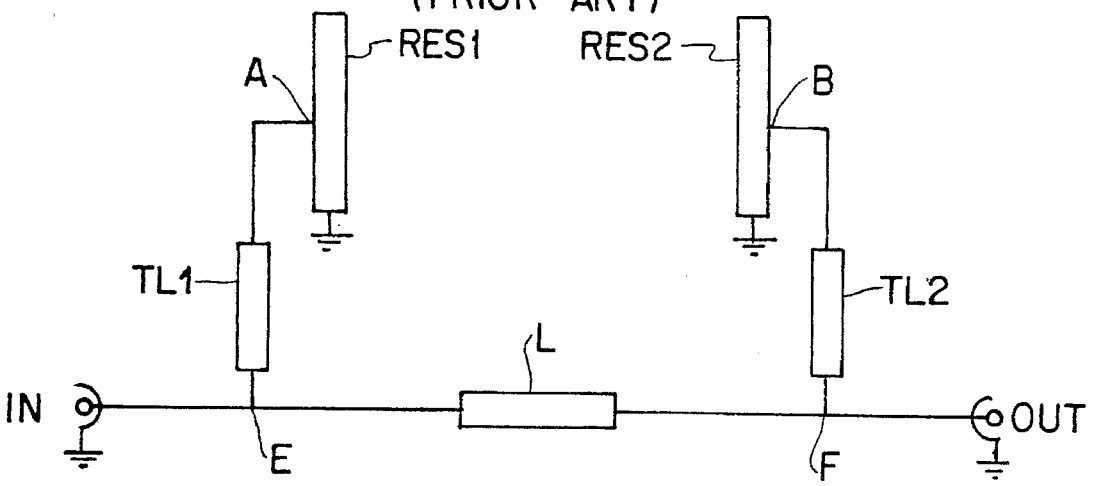
FIG. 1 (PRIOR ART)
FIG. 1 illustrates a known bandstop filter comprising two resonators.
Figure 2:
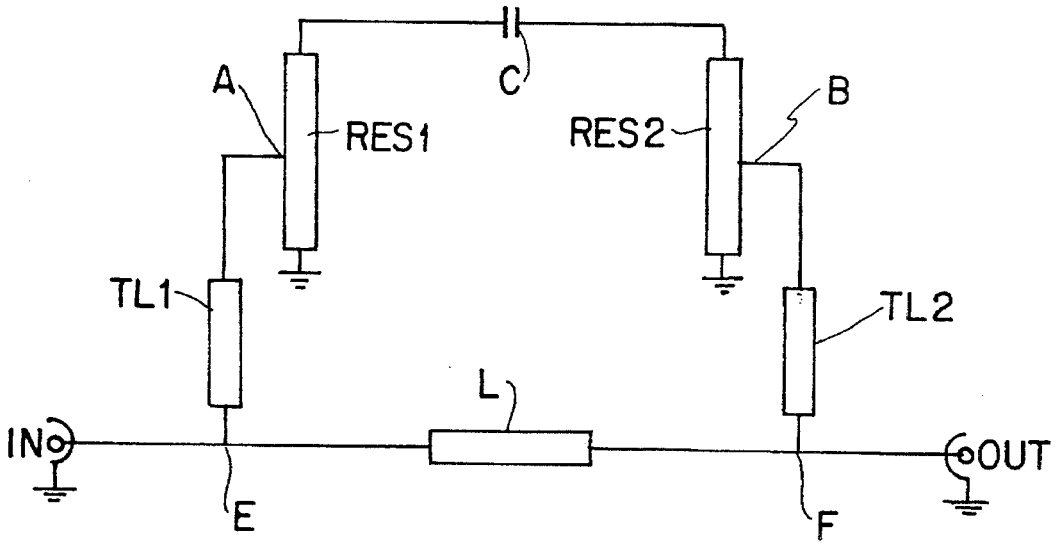
FIG. 2 (PRIOR ART)
FIG. 2 illustrates a known bandpass filter.
Figure 3A:
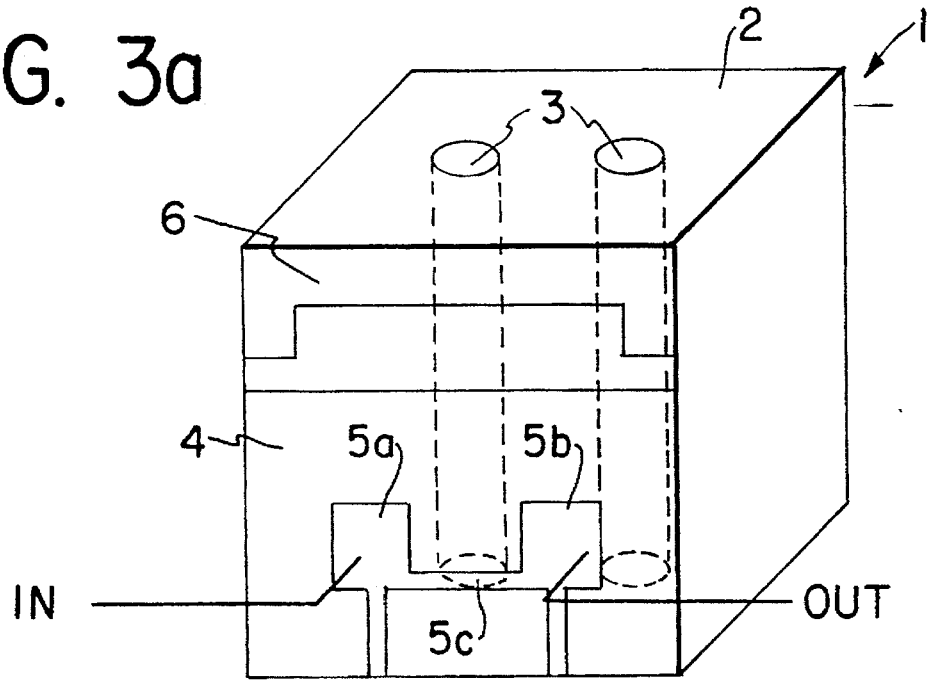
FIG. 3*a* illustrates a dielectric bandstop filter comprising two resonators.

FIG. 3*a* illustrates a dielectric bandstop filter 1 comprising a body of dielectric material having an upper and a lower surface and four side surface. The body is substantially coated by an electrically conducting layer although one side surface 4 is uncoated, as is the upper surface 2. The body has two bores 3, extending from the upper surface 2 to the lower surface and is also coated with a electrically conducting material. Each of the bores 3 form a transmission line resonator, on the uncoated side surface 4 the body has electrodes and electrically conducting coupling patterns provided thereon to provide the coupling to the resonators 3. In FIG. 3*a* the uncoated side surface 4 is provided with coupling spots 5*a*, 5*b* which thus form the tapping points A, B of the resonators shown in FIGS. 1 and 2. A strip line 5*c* provided between the coupling spots 5*a*, 5*b* to provide an inductance corresponding to the inductance L between the resonators RES1, RES2 of FIGS. 1 and 2. A strip line 6 is formed on the uncoated side surface 4 from one side of the filter to the other side, this strip line 6 appears as a ground plane between the high impedance, i.e. open circuited, end of the resonators RES1, RES2, thus decreasing the capacitive coupling between the resonators. A capacitive coupling between the resonators RES1, RES2 is obtained, by cutting the ends of the strip line 6 so that the strip line 6 no longer runs from one side of the filter body to the other, so as to obtain the strip line 6 of FIG. 3*b*, the strip line 6 is thus changed to a capacitive terminal and the filter is therefore altered into a filter of the passband type. If the strip line 5*c* is cut at both ends, then the inductance between the resonators (i.e. the inductance L of FIG. 1) disappears. This filter is also of the passband type, because (between the resonators RES1, RES2) there is some capacitive coupling provided by the strip line 6, and the cut strip line 5*c* does not have a great influence, because it is situated at the low impedance end of the resonators (i.e. in the magnetic field). When both strip lines 6 and 5*c* are cut (i.e. the equivalent of or the circuit according to the circuit of FIG. 2 with only the capacitance C, but no the inductance L) the filter is a pure bandpass filter. The strip lines 5*c*, 6 can be cut mechanically by machining or by a laser, or by any known means.

The filter type can be selectable by providing switches 8 which can be opened or closed depending on which type of filter we want to create. A filter 1, as described with reference to FIG. 3*a*, can have the strip lines 5*a* and 6 machined or cut as described above to be of the type described in relation to FIG. 3*b*. This filter is then provided with four switches 8, each switch 8 being arranged to bridge the gaps, formed by cutting the strip lines 5*c* and 6 as described above, when in the closed position. When the switches 8 are open, the gaps remain. Thus, when the switches 8 are closed, i.e. the gaps are bridged, then we have a filter as in FIG. 3*a* i.e. a bandstop filter, whereas, when the switches 8 are open, we have the filter of FIG. 3*b* i.e. a bandpass filter. Preferably the switch 8 is an electrically controlled switch, such as a semiconductor switch, with which the filter easily can be altered either into a bandpass filter or into a bandstop filter. It is also possible to alter the configuration from a bandpass filter (as in FIG. 3*b*) to a bandstop filter (as in FIG. 3*a*) mechanically instead of using the switch according to FIG. 3*c*, if we start with the bandpass filter according to the FIG. 3*b* where the capacitive coupling from the strip line 5*c* to the coupling spots 5*a*, 5*b* can be altered into an inductive one by connecting—using a jump wire—the strip line 5*c* to both coupling spots 5*a*, 5*b*, whereby we obtain the configuration of FIG. 3*a*.

Figure 4A:
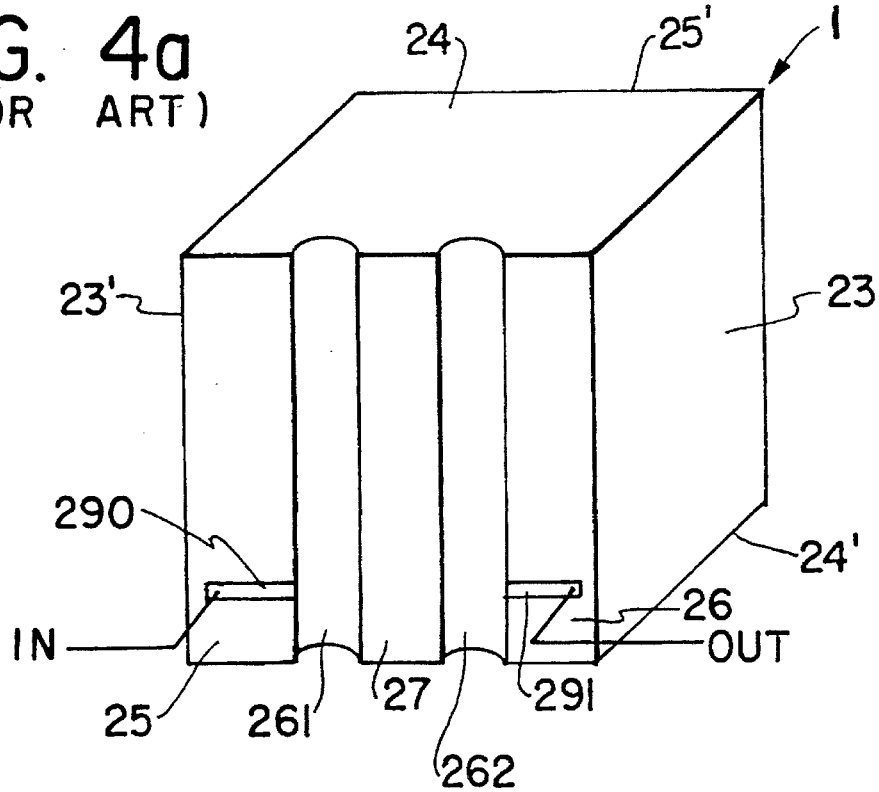
FIG. 4a (PRIOR ART)
FIG. 4*a* illustrates a dielectric filter having a groove structure.

FIG. 4*a* illustrates a known dielectric filter with a groove structure as disclosed in Finnish patent application Number 922101.

Figure 3B:
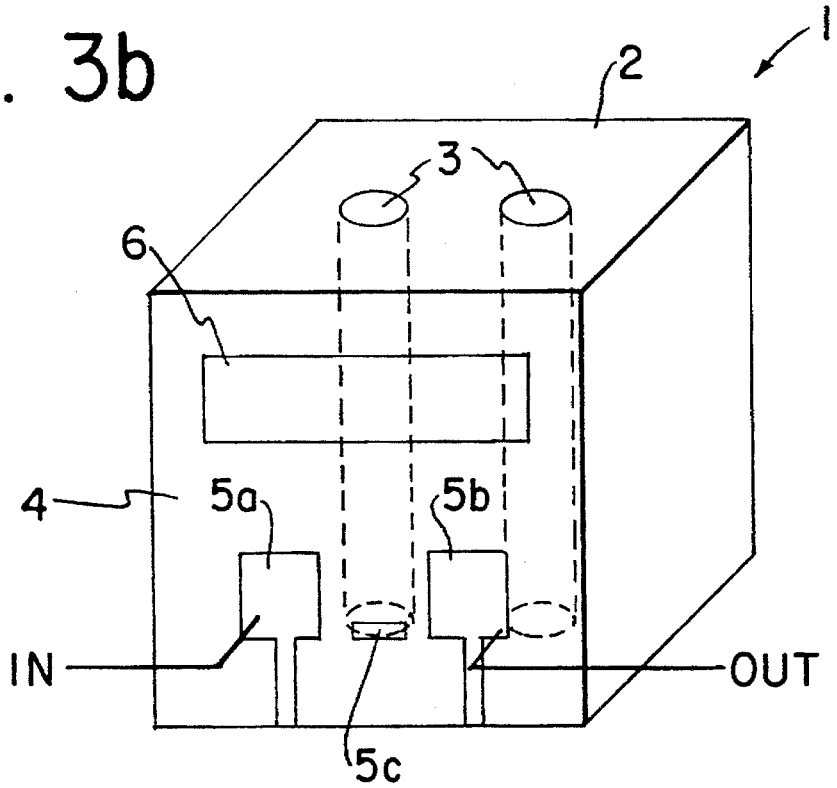
FIG. 3*b* illustrates a dielectric bandpass filter.
Figure 3C:
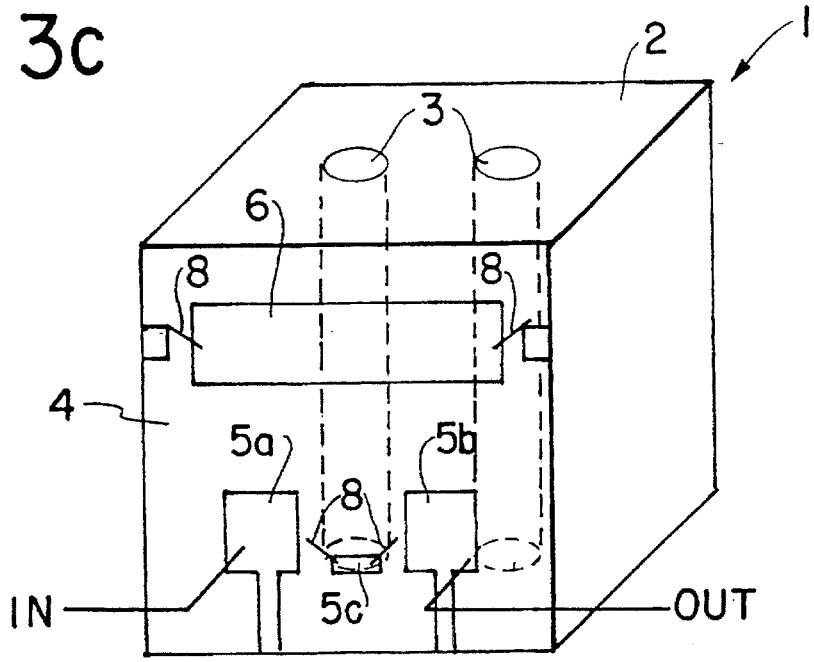
FIG. 3*c* illustrates a dielectric filter of a first embodiment of the invention.

The filter 11 formed by plane resonators 261, 262 is formed by a rod-like body of dielectric material, preferably ceramic material, having a rectangular cross-section, as is illustrated by the surface 24, hereinafter called the upper surface in the same way as the upper surface of the filter 1 shown in FIGS. 3*a* to 3*c*. Thus the body has a first side surface 25, 26, 27, a second side surface 25' end surfaces 23, 23' and a lower surface 24' and the upper surface 24. The surfaces denoted by an apostrophe are not visible in the figure, but the meaning is easily understood. Grooves 261, 262 are made in the first side surface 25,26,27 and they extend substantially parallel with the longer edge of the first side surface 25,26,27 along the whole length from the lower surface 24' to the upper surface 24, dividing the upper surface in several subsurfaces 25, 26, 27. The whole body, except for the upper surface 24 and the first side subsurfaces 25, 26, 27, are coated with an electrically excellently conducting material, e.g. with a silver-copper alloy. The surfaces of the grooves 261, 262 are also coated in the same process, and then conductor paths 290, 291 are arranged on the outer subsurfaces 25 and 26, the paths having one end connected to the coating of a groove. The other end of the conductor paths have connections for the signal conductors In and Out, respectively. At the edge adjacent the lower surface 24' the coating of the grooves 261, 262 is connected to the coating of the lower surface 24' acting as a ground plane, but the other ends terminate at the upper surface 24 which has no coating, so that, in an electrical sense, they are open circuited so that the grooves form quarter wavelength transmission line resonators. The resonators are mutually coupled mainly through the ceramic substrate.

Figure 4B:
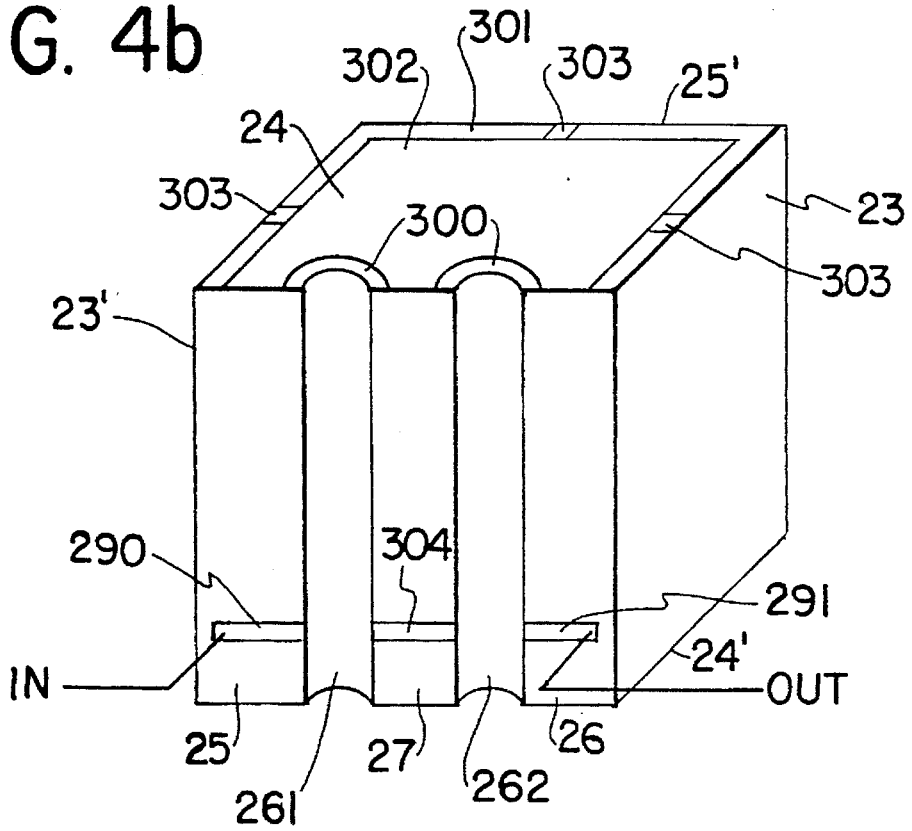
FIG. 4*b* illustrates a dielectric bandstop filter having a groove structure.

The filter structure shown in FIG. 4*a* can be altered into a bandstop filter by coating the upper surface 24 with electrically conducting material in the way shown in FIG. 4*b* with an uncoated area 300 left around the grooves 261, 262, and an uncoated area 301 left between the coating on the upper surface 24 and the end surfaces 23, 23' and the lower side surface 25' as illustrated in FIG. 4*b*, whereby the upper surface 24 is generally coated with a coating 302. When the coating 302 is connected at least to one end surface 23, 23' and/or to the lower side surface 25' at a few places via connection points 303 the coating 302 forms a ground plane in the same way as the strip line 6 of FIG. 3*a*. When the grooves are also connected along the first side subsurface 27 by means of a strip line 304 we obtain an inductive coupling between the resonators in the same way the inductance L of FIG. 1, whereby the filter acts as a bandstop filter. Alternatively the ground plane created by the coating 302 could be arranged as a strip line on the upper side surface 27 in the same way as in the filter according to FIG. 3*a*.

Figure 4C:
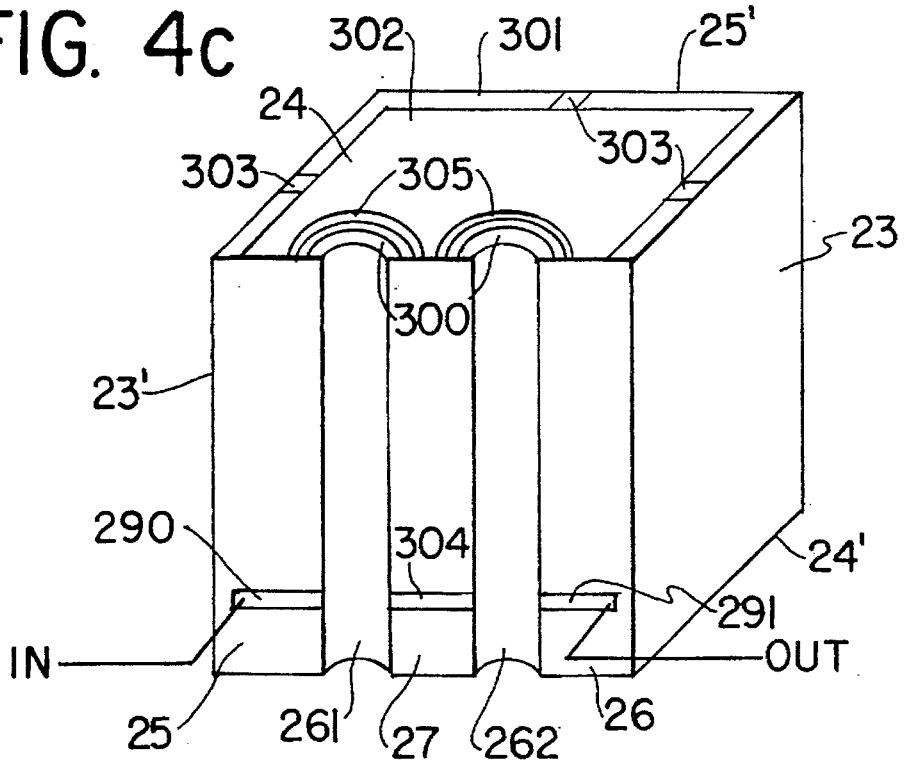
FIG. 4*c* illustrates a dielectric bandpass filter having a groove structure.

When a second uncoated area 305 is provided also around the grooves 261, 262 as illustrated in FIG. 4*c*, whereby there is coating between this area and the first uncoated area 300, this results in a capacitive coupling between the resonators, and a bandpass filter is obtained. When the coupling from the upper surface 24 to the lower side surface 25' is adjusted, e.g., with a capacitance, we obtain either a bandstop or a bandpass filter, depending on the ratio of capacitive and inductive coupling between the resonators, as was discussed above. The passband of the bandpass filter according to FIG. 4*c* is at the same frequency as the passband of the bandstop filter, which was obtained by adjusting it.

Figure 4D:
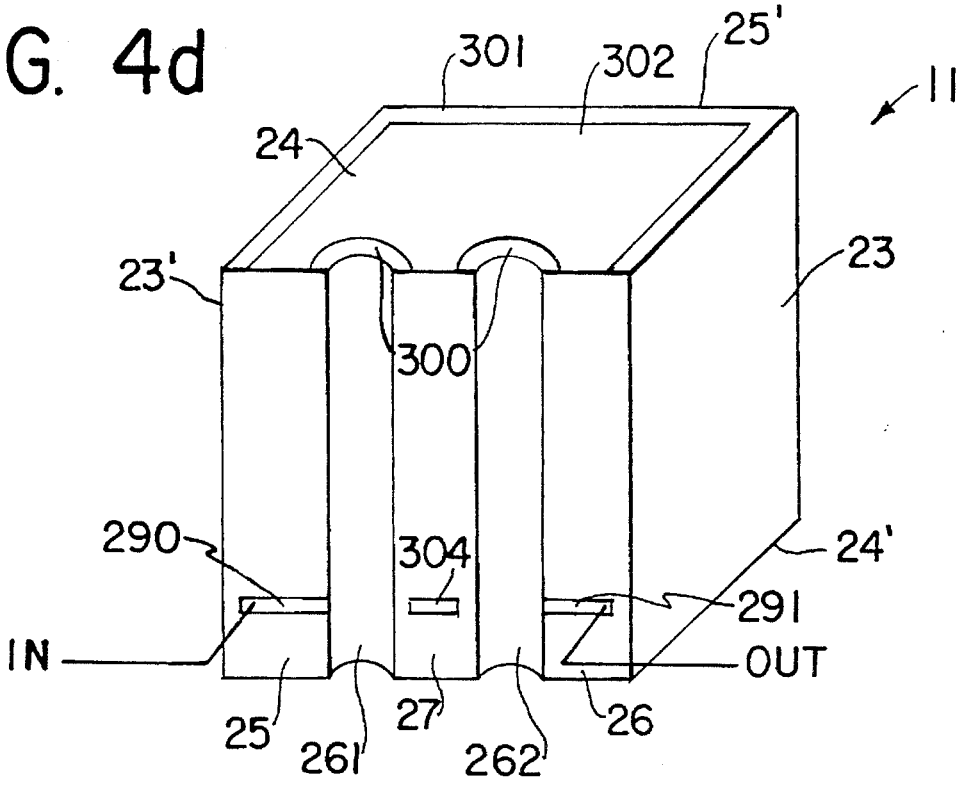
FIG. 4*d* illustrates a dielectric filter of a second embodiment of the invention.

Alternatively the connection points 303 of the coating 302 can be broken, so that the coating 302 on the upper surface 24 has no contact to may other surface, as is shown in FIG. 4*d*. Then the coating 302 forms a capacitive coupling C between the resonators, as in FIG. 2 whereby the filter acts as a bandpass filter. The strip line 304 can further be cut at the ends so that it will not contact the grooves 261, 262. In order to be able to switch from one filter type to the other (i.e. from bandstop to bandpass and vice versa), the connection points 303 can be in the form of switches as in FIG. 3*c*. They can be either mechanical or by electrically controlled switches such as semiconductor switches, e.g. by a transistor as with the embodiment of FIG. 3.

Figure 4E:
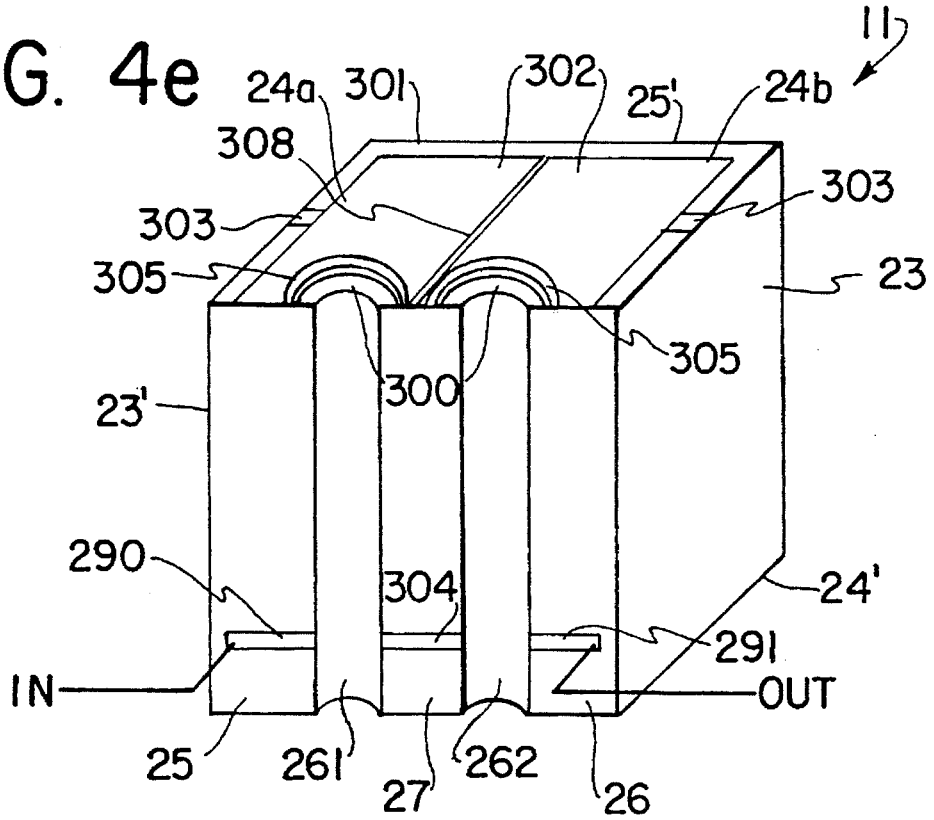
FIG. 4*e* illustrates a dielectric filter of a third embodiment of the invention.

When the coating 302 made at the upper surface 24 according to FIG. 4*e* is cut into surfaces 24*a* and 24*b* by arranging in the end surface between the resonators an uncoated area 308 extending from the side surface 25, 26, 27 to the lower side surface 25', this also results in a bandpass filter, but the passband of this bandpass filter is at the same frequency band as the passband of a bandstop filter realized by adjusting this filter. The filter type can here be selected by adjusting the coupling between the surfaces 24*a* and 24*b*.

It will be clear to a person skilled in the art, that various modifications are possible within the scope of the present invention. For example, it is only to dielectric filters, but corresponding alterations can be made between the inductive and the capacitive coupling also in filters of other types, such as helical, coaxial, or corresponding filters. A filter can also comprise more than two resonators, whereby the bandstop filter is realized by having an inductive coupling between the resonators, and a bandstop filter of this kind can be altered into a bandpass filter by having also a capacitive coupling between the resonators, or only a capacitive coupling, by altering the inductive coupling into a capacitive coupling, as in the case with two resonators.

I claim:

1. A dual-mode filter serving the function of one of e bandstop filter and a bandpass filter, the filter comprising at least two resonators;

a coupling device to affect coupling between said resonators, said coupling device being adaptable to provide a dominant inductive coupling in a first mode that causes the filter to function as a bandstop filter having a specific stop band and a dominant capacitive coupling in a second mode that causes the filter to function as a bandpass filter having a specific pass band; and selection means for selecting one of the first and second modes by causing said coupling device to provide one of dominant inductive coupling and capacitive coupling, respectively.

2. A dual-mode filter according to claim 1, wherein the filter Includes a body of dielectric material, the body having an uncoated upper surface and side surface, a lower surface and three side surfaces being substantially coated with an electrically conducting layer, and at least two bores extending from the upper surface to the lower surface, the bores being coated with an electrically conducting layer and forming the at least two resonators, and coupling means provided on the uncoated side surface for providing the coupling between the resonators.

3. A dual-mode filter according to claim 2, wherein the resonators each have a low impedance end toward the lower surface and an open-circuited end toward the uncoated upper surface, the coupling means including, in the first mode, the coupling pattern that includes a first strip line extending between the resonators on the uncoated side surface toward the lower surface for forming an inductive coupling between the resonators at their low impedance end and a second strip line extending between the resonators on the uncoated side surface toward the uncoated upper surface for forming a ground plane at the open-circuited end of the resonators, and in the second mode, an adjustment of the coupling pattern such that the inductive coupling formed by the first strip line is reduced relative to that in the first mode, and the second strip fine is changed relative to that in the first mode to provide capacitive coupling between the resonators at their open-circuited end.

4. A dual-mode filter serving the function of one of a bandstop filter and a bandpass filter, the dual-mode filter comprising:

at least two resonators formed in a body of dielectric material having an uncoated upper surface and a side surface, and a lower surface and three side surfaces being substantially coated with an electrically conducting layer, and at least two grooves formed on the uncoated side surface, the grooves being coated with an electrically conducting layer so as to form said at least two resonators;

coupling means provided on the uncoated side surface and the upper surface of said body of dielectric material to affect coupling between said resonators, said coupling means being adaptable to provide a dominant inductive coupling in a first mode that causes the filter to function as a bandstop filter having a specific stop band and a dominant capacitive coupling in a second mode that causes the filter to function as a bandpass filter having a specific pass band; and selection means for selecting one of the first and second modes by causing said coupling means to provide one of dominant inductive coupling and capacitor coupling, respectively, said coupling means being selectable by the selection means to provide dominant inductive coupling in the first mode and dominant capacitive coupling in the second mode.

5. A filter according to claim 4, wherein the coupling means comprises a strip line provided on the uncoated side surface of the body of dielectric material and forming an inductive coupling between the resonators at their low impedance end, and a coating on the upper surface connected by at least one connection point to the electrically conducting material on the coated side surface to form a ground plane in the first mode, and in the second mode, the coupling pattern is selected by the selection means such that the inductive coupling formed by the strip line is reduced, and the at least one connection point is removed to form capacitive coupling between the resonators.

6. A filter as claimed in claim 5, wherein the coupling means is selected by the selection means which selection means comprises switches provided at the connection points and coupled to the strip line such that, in the first mode, the switches are in a closed position to provide the ground plane and the inductive coupling respectively, and, in the second mode, the switches are in an open position to provide the capacitive coupling and the reduced inductive coupling respectively.

7. A filter according to claim 6, wherein the switches are mechanical switches.

8. A filter according to claim 6, wherein the switches are electrically operated switches.

9. A filter according to claim 6, wherein the switches are semiconductor switches.

10. A filter according to claim 4, wherein the coupling means is selected by the selection means, which selection means comprises switches coupled to first and second strip lines such that, in the first mode, the switches are in a closed position to provide the inductive coupling and ground plane respectively, and, in the second mode, the switches are in an open position to provide the reduced inductive coupling and the capacitive coupling respectively.

11. A filter according to claim 10, wherein the switches are mechanical switches.

12. A filter according to claim 10, wherein the switches are electrically operated switches.

13. A filter according to claim 10, wherein at least one of the switches is a semiconductor switch.

* * * * *

UNITED STATES PATENT AND TRADEMARK OFFICE

CERTIFICATE OF CORRECTION

PATENT NO. : 5,541,560

DATED : July 30, 1996

INVENTOR(S) : Aimo TURUNEN and Heli JANTUNEN

It is certified that error appears in the above-indentified patent and that said Letters Patent is hereby corrected as shown below:

Title page, item [21], Appl. No.:, change "202,940" to --202,924--.

Signed and Sealed this

Twenty-ninth Day of October 1996

Bruce Lehman

*Attest:*

BRUCE LEHMAN

*Attesting Officer*

*Commissioner of Patents and Trademarks*